US006135223A

United States Patent [19]

Miyachi et al.

[11] Patent Number: 6,135,223

[45] Date of Patent: Oct. 24, 2000

[54] GUARD COVER FOR A CONSTRUCTION MACHINE

[75] Inventors: Isao Miyachi; Shintaro Sakitani, both of Hiroshima, Japan

[73] Assignee: Kabushiki Kaisha Kobe Seiko Sho, Kobe, Japan

[21] Appl. No.: 09/371,005

[22] Filed: Aug. 10, 1999

Related U.S. Application Data

[63] Continuation of application No. PCT/JP98/05942, Dec. 25, 1998.

[30] Foreign Application Priority Data

Dec. 26, 1997 [JP] Japan ..... 9-361145

[51] Int. Cl.[7] ..... B62D 25/10; B62D 39/00

[52] U.S. Cl. ..... 180/69.21; 180/89.17

[58] Field of Search ..... 180/89.13, 89.17, 180/326, 329, 69.2, 289, 69.21; 296/207, 901, 191, 190.11; 74/608

[56] References Cited

U.S. PATENT DOCUMENTS

| | | | |
|---|---|---|---|
| 4,415,052 | 11/1983 | Gauer | 180/89.17 |
| 4,770,263 | 9/1988 | Yoshioka | 180/89.17 |
| 4,787,668 | 11/1988 | Kawase et al. | 296/93 |
| 5,341,926 | 8/1994 | Leben | 206/307 |
| 5,645,134 | 7/1997 | Frankel et al. | 180/69.2 |
| 5,782,312 | 7/1998 | Murakawa | 180/69.2 |
| 6,058,903 | 5/2000 | Downham | 123/198 E |

FOREIGN PATENT DOCUMENTS

| | | | |
|---|---|---|---|
| 7-207702 | 8/1995 | Japan . | |
| 8-209743 | 8/1996 | Japan . | |
| 8-311926 | 11/1996 | Japan . | |
| 1652165 | 5/1991 | U.S.S.R. | 180/69.2 |

*Primary Examiner*—Brian L. Johnson
*Assistant Examiner*—Michael Britton
*Attorney, Agent, or Firm*—Oblon, Spivak, McClelland, Maier & Neustadt, P.C.

[57] ABSTRACT

A guard cover for a construction machine includes first guard cover (12), the first guard cover covering devices to be inspected from both front and upper surface sides of the devices, the first guard cover capable of being opened and closed vertically, and a second guard cover (13) which becomes contiguous to the first guard cover (12) when closed and which covers devices to be subjected to servicing from a side of the devices, the second guard cover capable of being opened and closed in the transverse direction. According to this construction, the first and second guard covers can be opened each independently, so the devices to be subjected to inspection can be inspected by an operator within an opened range of the first guard cover (12) and the devices to be subjected to servicing can be serviced by a serviceman within an opened range of the second guard cover (13). Thus, the object of inspection by the operator and the object of servicing by a serviceman are clearly distinguished from each other, resulting in that both inspecting work and servicing work are greatly improved in their efficiency.

6 Claims, 4 Drawing Sheets

GUARD COVER FOR A CONSTRUCTION MACHINE

This application is a continuation of PCT/JP98/05942 filed Dec. 25, 1998.

FIELD OF ART

The present invention relates to a guard cover for a construction machine and more particularly a guard cover for protecting devices to be subjected to inspection or servicing which devices are gathered on a revolving frame as a base of a rotatable superstructure in a construction machine such as a hydraulic excavator, the guard cover being constructed so as to be opened at the time of inspection, repair and maintenance.

BACKGROUND ART

In a construction machine such as a hydraulic excavator, various devices and pipes are disposed on a revolving fiame of a rotatable superstructure, such as hydraulic actuators for actuating a front attachment and a lower carriage, a hydraulic pump for supplying a hydraulic oil to each of the actuators, and an engine unit for actuating the hydraulic pump. These devices and associated pipes are protected by a bonnet.

A guard cover capable of being opened vertically through a hinge is mounted at a front part of the revolving frame which is positioned sideways of a boom support portion of the front attachment and on the side opposite to a cabin.

Inside the guard cover are disposed such devices as control valve for controlling the flow rate and direction of hydraulic oil to be fed to each hydraulic actuator, operation pattern change-over valve for changing over from one correlation to another between the operating direction of an operating lever and a hydraulic actuator operated thereby, filter, hydraulic oil tank, fuel tank, and battery.

These devices are usually gathered in one place for ease of work at the time of start-up of the machine or for convenience to servicing, including repair and maintenance. For example, inspection works such as inspection of the amount of oil in the fuel tank, inspection of the amount of hydraulic oil, and inspection of the battery, as well as the operation of the operation pattern change-over valve, are performed mainly by the operator of the hydraulic excavator.

On the other hand, servicing works such as checking oil leakage of the control valve, hydraulic oil tank and hose, and additional clamping of a pipe portion mounted to the control valve, are performed mainly by a serviceman sent from a manufacturing company of the hydraulic excavator. Thus, the works carried out with the guard cover open are classified into the inspection works performed by the operator of the hydraulic excavator and the servicing works performed by a serviceman.

However, according to the structure of a conventional guard cover, the operator or serviceman is required to peiform inspection or servicing of various devices while looking into the interior from an opening which is formed by opening the guard cover upward. This raises the problem that the working efficiency is low.

In the case of a guard cover as a constituent of an outer shell of a rotatable superstructure, which guard cover is formed integrally in an inverted U shape in section from an upper surface toward both side faces of the outer shell, the whole of the guard cover, which is bulky, must be opened even when inspection alone is to be conducted. Besides, in such a bulky guard cover, a support fiame for supporting the guard cover must be extended from the revolving frame of the rotatable superstructure and it has so far been an obstacle to the inspection or servicing work.

SUMMARY OF THE INVENTION

The present invention has been accomplished in view of the above-mentioned problems encountered in the conventional hydraulic excavator guard cover and it is an object of the invention to provide a guard cover for a construction machine which can be opened separately at a required portion thereof according to an inspecting or servicing work and which therefore can greatly improve the inspecting or servicing work efficiency.

DISCLOSURE OF THE INVENTION

The guard cover for a construction machine according to the present invention comprises a first guard cover which covers devices to be inspected and devices for servicing fiom the front to the upper surface side of the devices and which can be opened and closed in the rising and falling direction of a boom through a hinge provided at a rear end portion of an upper plate portion of the guard cover, and a second guard cover which covers the said devices from a side face side thereof and which can be opened and dosed in the transverse direction of the rotatable superstructure through a hinge provided at the rear end portion of a cover side plate portion.

In the present invention it is preferable that the first and second guard covers be divided at the boundary between an inspection range for the devices to be inspected and a servicing range for the devices for servicing. Further, it is desirable to constitute the second guard cover so as to be contiguous to the first guard cover and support the lower edge of the first guard covers, in a closed state of the guard cover of the invention.

According to the present invention, the guard covers can be opened independently according to the object for inspection or for servicing, so for the devices to be inspected by the operator, the inspecting operation can be done within the opened area of the first guard cover, and for the devices for servicing such as repair to be done by a serviceman, the servicing operation can be done within the opened area of the second guard cover. Thus, the objects to be inspected by the operator and those for servicing by the serviceman are clearly distinguished from each other, giving rise to an advantage that the efficiency of the inspecting and servicing works is greatly improved. Besides, with both first and second covers opened, the inspecting and servicing works become easier because there is no such reinforcing frame as will be an obstade.

It is preferable that a buffer member be attached to the upper edge of the side plate portion of the second guard cover which supports the lower edge of the side plate portion of the first guard cover. In the case that the buffer member is attached, the first guard cover when closed can be cushioned by the second guard cover, thus preventing the first guard cover from being deformed by a closing shock.

It is preferable that the first guard cover be formed of a resin and the second guard cover be formed by a steel plate. The use of a resin for the first guard cover is advantageous in that the resulting reduction in weight of the guard cover facilitates the cover opening and closing motions at the time of inspection for example. The first guard cover may be of a hollow double-shell structure obtained by a rotational molding of a resin. If such a hollow structure formed by a rotational molding is utilized, not only a voluminous guard cover of a complicated shape can be fabricated easily, but also it is possible to attain the reduction of weight.

BRIEF DESCRIPTION OF THE DRAWINGS

FIGS. 1A, 1B, 1C illustrate the construction of the guard cover according to the present invention as applied to a rotatable superstructure of a hydraulic excavator, in which FIG. 1A is a plan view, FIG. 1B is a front view, and FIG. 1C is a right side view;

BEST MODE FOR CARRYING OUT THE INVENTION

The present invention will be described in detail hereinunder by way of a preferred embodiment thereof illustrated in FIGS. 1 to 4.

Figure 1A:
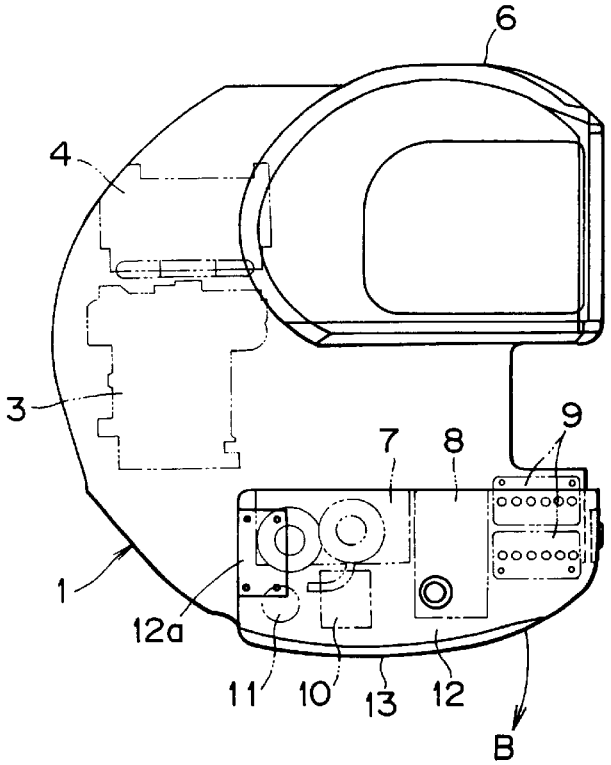
Figure 1B:
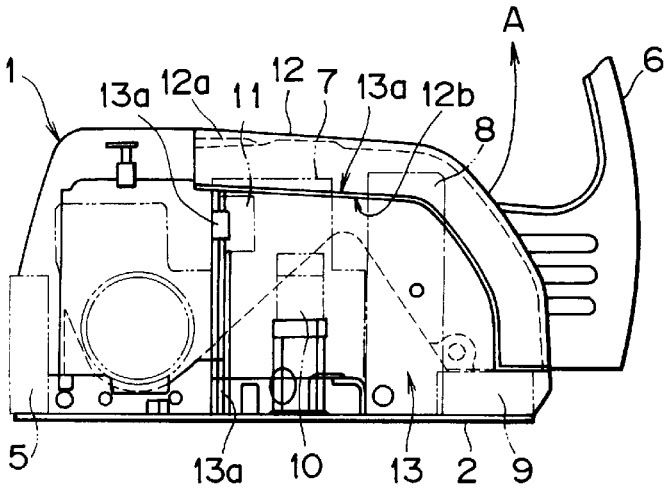
Figure 1C:
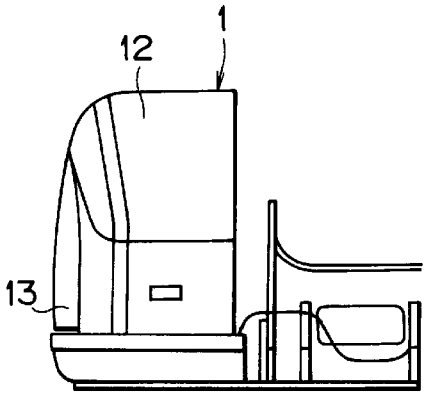

In FIGS.1(*a*) to 1(*c*), the reference numeral 1 denotes a rotatable superstructure of a hydraulic excavator. On a rear portion of a revolving frame 2, which serves as a base of the rotatable superstructure, are installed an engine 3 as a hydraulic pump drive source, a radiator 4 for preventing overheating of the engine 3, a counterweight 5, and a hydraulic pipe (not shown).

On a left-hand front portion of the revolving frame 2 is provided a cab 6 for getting therein of the operator of the hydraulic excavator, while on a right-hand front poition of the revolving frame are gathered devices which are to be inspected periodically or at the time of start-up of the hydraulic excavator, as well as devices to be subjected to servicing, including repair and maintenance. The devices for inspection or servicing include a hydraulic oil tank 7 to be checked for the amount of oil, a fuel tank 8 to be checked also for the amount of oil, a battery 9 to be checked for the state of the battery, a control valve 10 to be checked for oil leakage, an operation pattern change-over valve 11 which makes sure how the operating direction of an operating lever and the hydraulic actuator operated thereby are correlated with each other, and a pipe connection of a hydraulic device.

The numeral 12 denotes a first guard cover, which constitutes a part of the outer shell of the rotatable superstructure. The first guard cover 12 is curved from the front face of the said outer shell and is contiguous to the upper surface of the outer shell to constitute both right-hand front plate portion and upper plate portion of the outer shell. The section of the first guard cover 12 is in an inverted U shape. The first guard cover 12 can be opened and closed in the vertical direction (in the boom rising and falling direction like arrow A in the figure) through a hinge 12*a* secured to a rear end portion of the first guard cover. The first guard cover 12 is formed of a resin.

On the other hand, a second guard cover 13 is formed in the shape of a door by pressing a steel plate so as to form the outer shell side plate on the right-hand front portion of the rotatable superstructure 1 and it can be opened and closed in the right and left direction (in the width direction of the rotatable superstructure like arrow B in the figure) through a pair of hinges 13*a* attached to a rear end portion of the second guard cover.

In the guard cover composed of the first and second guard covers 12, 13, when the first guard cover 12 is closed after closing the second guard cover 13, a lower edge portion 12*b* of the first guard cover comes into abutment against an upper edge portion 13*a* of the second guard cover, whereby both guard covers 12 and 13 are connected together so as to be flush with each other.

The construction of the first guard cover 12 and that of the second guard cover 13 will be described below in more detail.

Figure 2:
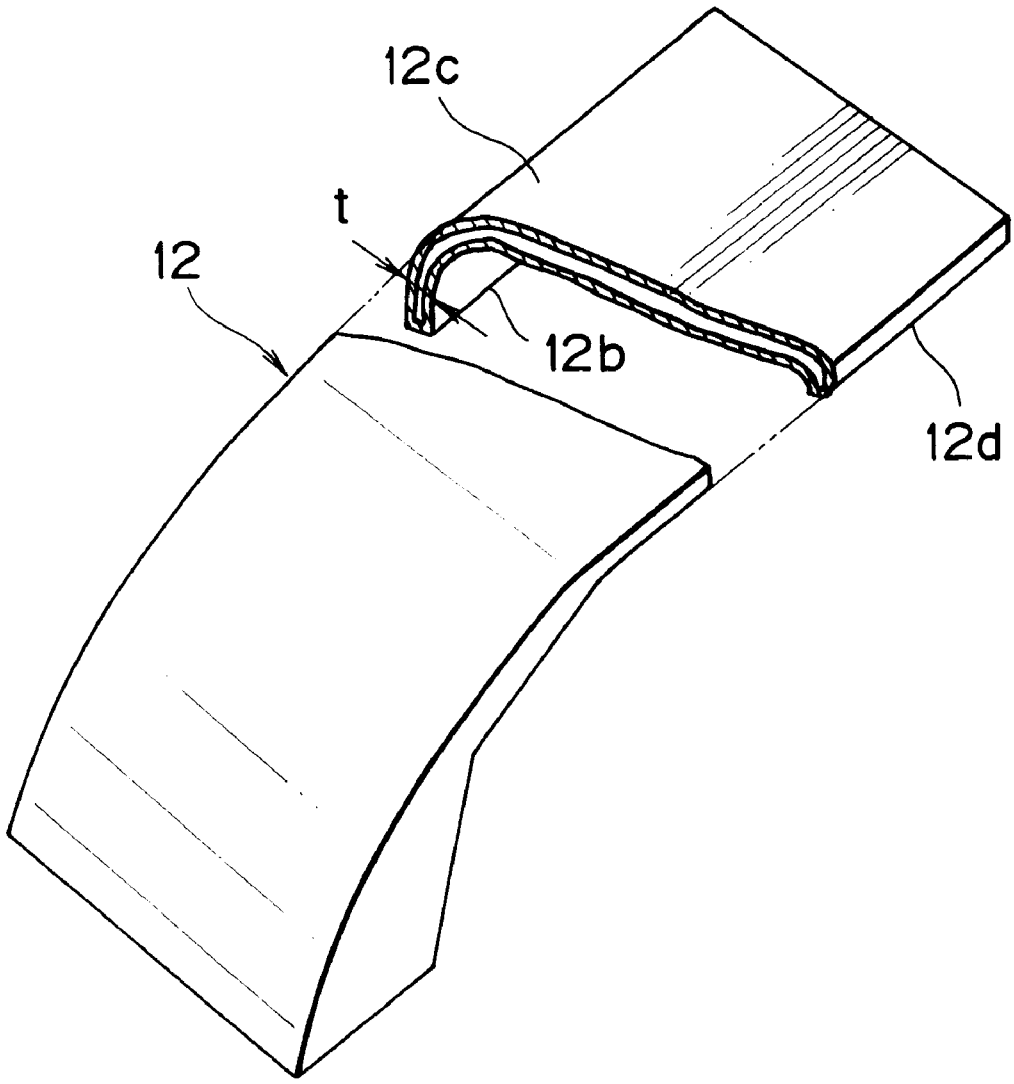
FIG. 2 is a perspective view showing the structure of a first guard cover.

As shown in FIG.2, the first guard cover 12 has a double-shell hollow structure obtained by a rotational molding of a polyethylene resin. A total plate thickness, t, of the first guard cover 12 is 80 mm and the thickness of an outer shell (inner shell) 12*c* is 4 mm. By utilizing the rotational molding it is possible to easily fabricate a voluminous first guard cover 12 of a complicated shape and also possible to reduce the weight of the guard cover.

Figure 3B:
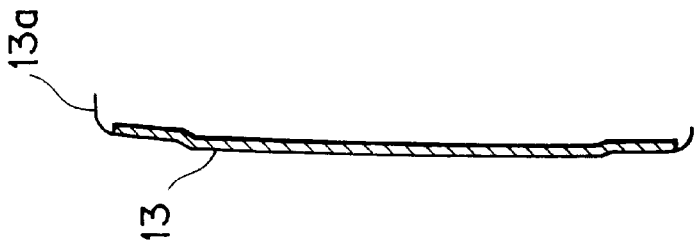
FIGS. 3A, 3B are an explanatory view showing the structure of a second guard cover.
Figure 3A:
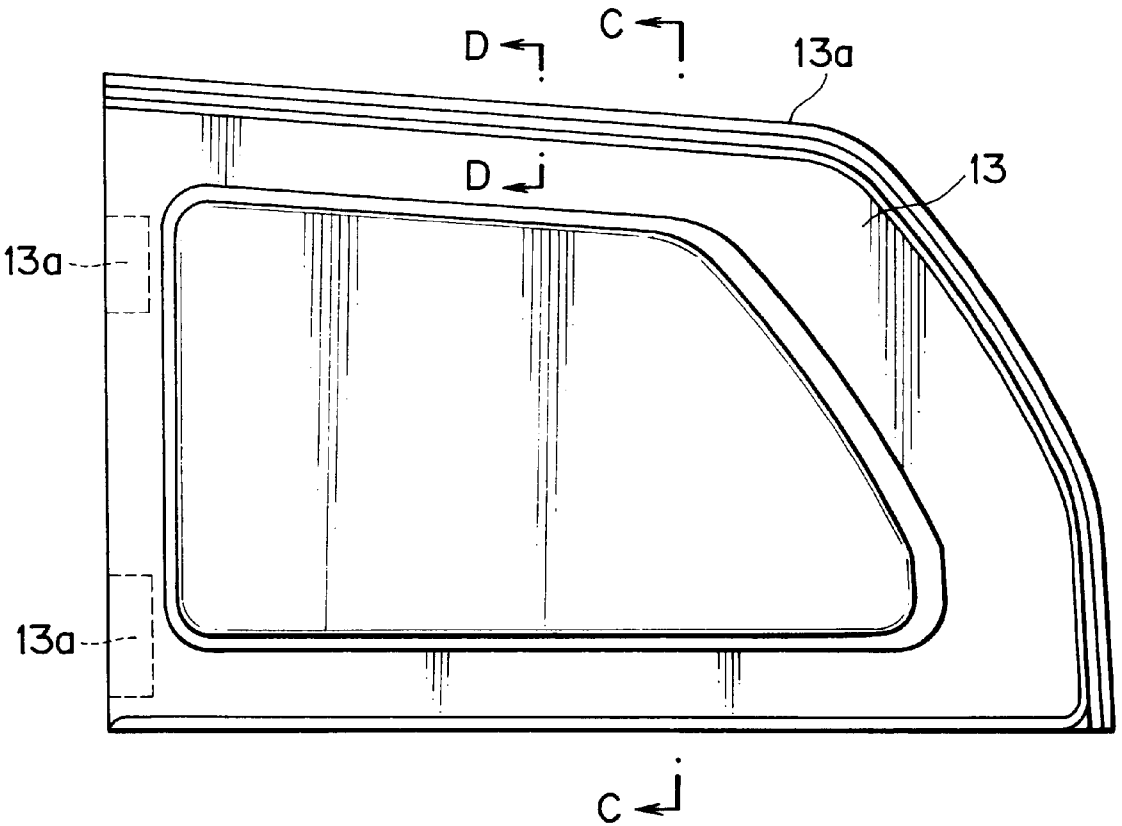
Figure 4:
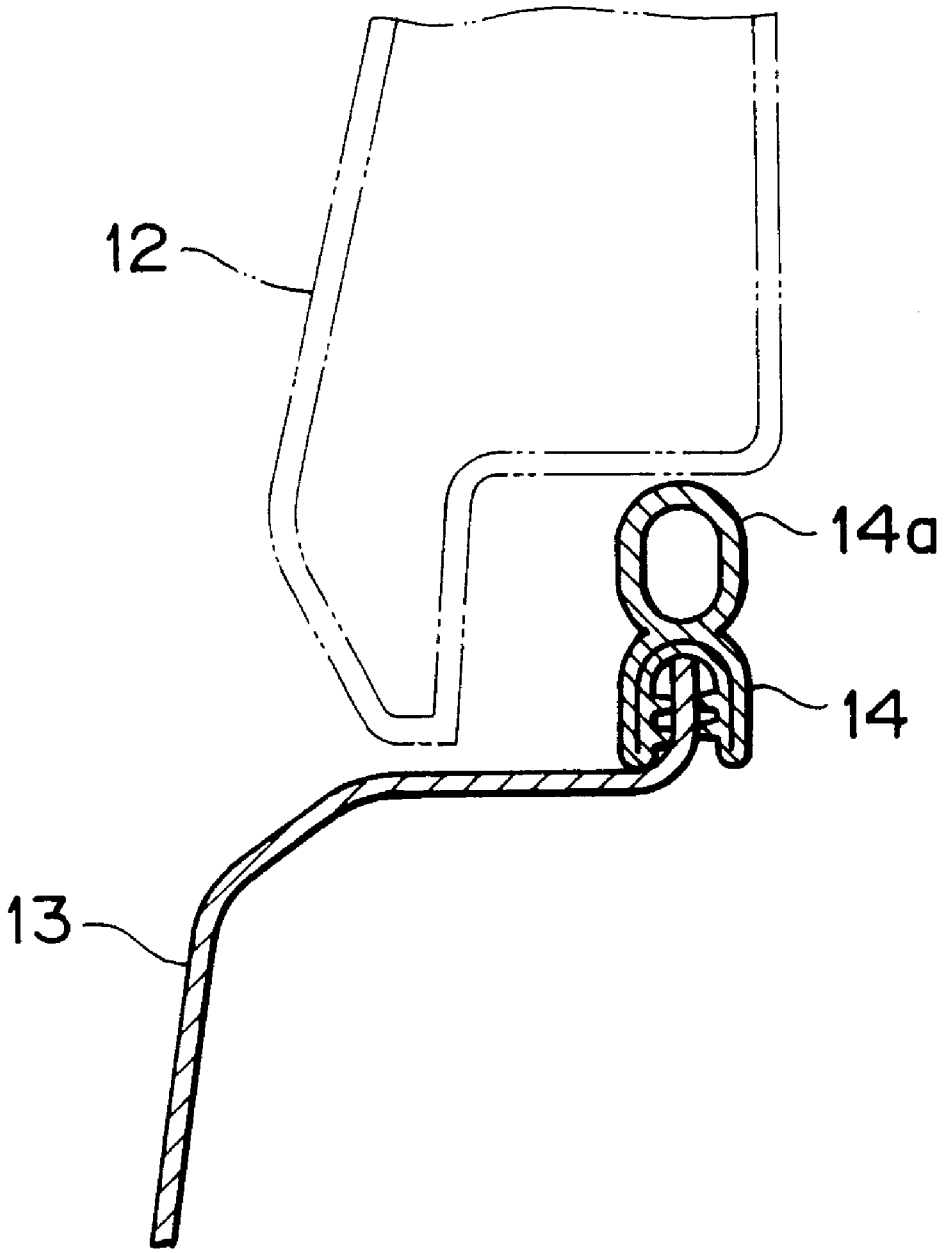
FIG. 4 is an enlarged sectional view showing a support structure for the first guard cover.

Next, as shown in FIGS. 3(*a*) and (*b*), the second guard cover 13 has the upper edge portion 13*a* formed so as to be opposed to the lower edge portion 12*b* (see FIG.2) of the first guard cover 12. On the upper edge portion 13*a* is fitted a long weather strip 14 made of rubber, as shown in FIG.4.

A cylindrical portion 14*a* is integral with an outer peripheral portion of the weather strip 14 and it serves as a buffer member when the first guard cover 12 is closed. Thus, the upper edge portion 13*a* of the second guard cover 13 can softly bear the lower edge portion 12*b* of the first guard cover 12 when closed and, after closing, can support the first guard cover. A lower edge portion 12*d* (see FIG.2) of the first guard cover 12 is supported by a fixed outer shell side plate (not shown) mounted vertically from the revolving frame 2, which cover is also provided at its upper edge portion with a weather strip of the same structure as in FIG. 4 and having the cylindrical portion 14*a*.

Thus, the lower edge portions 12*b* and 12*d* of the first guard cover are supported by the second guard cover 13 and the fixed outer shell side plate, respectively, so the operator can get on the first guard cover 12 and check the front attachment for example.

In FIG. 3, 13*b*', 13*b*' represent mounting positions of the hinges 13*b* secured to the rear end portion of the second guard cover 13. The first and second guard covers 12, 13 are each provided with a lock mechanism adapted to lock the revolving frame 2 and the first guard cover unlockably. As the lock mechanism there may be utilized a known lock mechanism wherein a hook attached to the front lower end of, for example, the first guard cover is brought into engagement with an engaging hole formed in the revolving frame.

Next, the operations of the first and second guard covers having the above constructions will be described below with reference to FIG. 1.

When the first guard cover 12 is unlocked and is opened in the direction of arrow A for start-up inspection or periodical inspection, an upper portion of the hydraulic oil tank 7 and that of the fuel tank 8, as well as the battery 9 and the operation pattern change-over valve 11, are exposed. Therefore, the operator of the hydraulic excavator can complete the inspection work by inspecting the devices thus exposed upon opening of the first guard cover 12 and by operating the operation pattern change-over valve 11.

On the other hand, when the second guard cover 13 is unlocked and is opened in the direction of arrow B, the control valve 10, operation pattern change-over valve 11, a side portion of the hydraulic oil tank 7 and a hose connected to a hydraulic device are exposed. Therefore, a serviceman can check oil leakage of the control valve 10,hydraulic oil tank 7 and hose and effect additional clamping of a pipe portion mounted to the control valve 10.

Further, when both first and second covers 12, 13 are opened, all of the devices protected by both covers are exposed. Besides, with both guard covers opened, it is possible to effect inspection and servicing of the devices in a simple manner from both front and side because the support frame which has been used to support the guard cover of the conventional structure is not present.

Although the first guard cover used in the above embodiment is of a hollow double-shell structure obtained by a rotational molding, no limitation is made thereto. For example, the first guard cover may be constituted by an FRP cover or may be constituted by pressing a steel plate.

Further, although the guard cover of the above embodiment was applied to a hydraulic excavator, the present invention is not limited thereto. For example, the invention is also applicable to such a construction machine as a crane.

INDUSTRIAL APPLICABILITY

As set forth hereinabove, the guard cover for a construction machine according to the present invention is useful as a guard cover in the rotatable superstructure of a hydraulic excavator or of a crane. Particularly, the guard cover is suitable for the protection of devices to be subjected to inspection or servicing.

We claim:

1. A guard cover in a construction machine to be used for protecting devices which are gathered in a certain portion of the construction machine and which protects devices to be subjected to inspection or servicing, said guard cover comprising:

a first guard cover which covers said devices from both front and upper surface sides of the devices and which is constructed so as to be capable of being opened and closed vertically through a hinge secured to a rear end portion of the first guard cover; and a second guard cover which covers said devices from a side of the device and which is constructed so as to be capable of being opened and closed horizontally through a hinge secured to a rear end portion of the second guard cover, wherein said first and second guard covers are constructed so as to divided along a boundary between an inspection range for the devices to be subjected to inspection and a servicing range for the devices to be subjected to servicing, and wherein said second guard cover is constructed so as to become contiguous to said first guard cover when closed and support a lower end portion of the first guard cover.

2. A guard cover in a construction machine according to claim 1, wherein a buffer member for absorbing an impact force developed when closing said first guard cover is provided at an upper edge portion of said second guard cover which supports the first guard cover.

3. A guard cover in construction machine according to claim 1, wherein said first guard cover is formed using a resin and said second guard cover is formed by a steel plate.

4. A guard cover in a construction machine according to claim 1, wherein said first guard cover is formed using a resin and said second guard cover is formed by a steel plate.

5. A guard cover in a construction machine according to claim 3, wherein said first guard cover has a hollow double-shell structure formed by a rotational molding.

6. A guard cover in a construction machine according to claim 4, wherein said first guard cover has a hollow double-shell structure formed by a rotational molding.

* * * * *